US011713866B2

(12) United States Patent
Li et al.

(10) Patent No.: US 11,713,866 B2
(45) Date of Patent: Aug. 1, 2023

(54) LIGHT FIXTURE

(71) Applicants: OPPLE LIGHTING CO., LTD., Shanghai (CN); SUZHOU OPPLE LIGHTING CO., LTD., Suzhou (CN)

(72) Inventors: Shuchao Li, Suzhou (CN); Yisheng Xiao, Suzhou (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/564,171

(22) Filed: Dec. 28, 2021

(65) Prior Publication Data

US 2022/0120413 A1 Apr. 21, 2022

Related U.S. Application Data

(63) Continuation of application No. PCT/CN2020/137183, filed on Dec. 17, 2020.

(30) Foreign Application Priority Data

Dec. 19, 2019 (CN) ..... 201922306972.4

(51) Int. Cl.
*F21V 15/01* (2006.01)
*F21V 17/10* (2006.01)
(Continued)

(52) U.S. Cl.
CPC ..... *F21V 15/01* (2013.01); *F21V 17/104* (2013.01); *F21V 17/16* (2013.01); *F21V 21/044* (2013.01); *F21V 21/047* (2013.01); *F21V 21/049* (2013.01)

(58) Field of Classification Search
CPC .... F21V 21/049; F21V 21/044; F21V 21/045; F21V 21/047; F21V 21/04; F21V 21/041;
(Continued)

(56) References Cited

U.S. PATENT DOCUMENTS 8,579,458 B2 * 11/2013 Okamura ..... F21V 21/044 362/148
8,770,781 B2 * 7/2014 Yamamoto ..... F21V 29/74 362/373
8,827,506 B2 * 9/2014 Osada ..... F21V 19/00 362/148

FOREIGN PATENT DOCUMENTS

CN 204665057 U * 9/2015
CN 204665057 U 9/2015
(Continued)

OTHER PUBLICATIONS

English translation of CN208282037U, 4 pages. (Year: 2018).*
(Continued)

*Primary Examiner* — Laura K Tso
(74) *Attorney, Agent, or Firm* — Arch & Lake LLP

(57) ABSTRACT

The present disclosure discloses a light fixture, which includes a light body and elastic mounting members. The light body includes a light housing and a limiting element, the limiting element is connected to the light housing, a limiting space is enclosed by the light housing and the limiting element, one end of the limiting space is provided with a mounting opening, the limiting element has a matching notch, the matching notch is formed by extending from the mounting opening to an inside of the limiting element, and the light housing recesses to be provided with a limiting slot that communicates with the limiting space; and each elastic mounting member includes a clamping portion and a mounting portion, the clamping portion includes a base body and an elastic clip, the elastic clip is elastically connected to the base body.

13 Claims, 5 Drawing Sheets

(51) Int. Cl.
*F21V 17/16* (2006.01)
*F21V 21/04* (2006.01)

(58) Field of Classification Search
CPC ..... F21V 21/042; F21V 15/01; F21V 17/104; F21V 17/16; F21V 17/164; F21V 17/162; F21S 8/026; F21S 8/02
USPC ..... 362/148, 365
See application file for complete search history.

(56) References Cited

FOREIGN PATENT DOCUMENTS

| | | | | |
|---|---|---|---|---|
| CN | 207146135 | U | | 3/2018 |
| CN | 207334465 | U | | 5/2018 |
| CN | 208282037 | U | * | 12/2018 |
| CN | 208282037 | U | | 12/2018 |
| CN | 209540670 | U | | 10/2019 |
| CN | 211083815 | U | | 7/2020 |
| JP | 2017208238 | A | | 11/2017 |

OTHER PUBLICATIONS

English translation of CN204665057U, 5 pages. (Year: 2015).*
International Search Report of PCT Application No. PCT/CN2020/137183 dated Mar. 1, 2021 with English translation, (5p).

* cited by examiner

LIGHT FIXTURE

CROSS-REFERENCE TO RELATED APPLICATIONS

This application is based upon and claims the priority of PCT patent application No. PCT/CN2020/137183 filed on Dec. 17, 2020 which claims priority to the Chinese patent application No. 201922306972.4 filed on Dec. 19, 2019, the entire contents of which are hereby incorporated by reference herein for all purposes.

TECHNICAL FIELD

The present disclosure relates to the technical field of lighting equipment, and in particular to a light fixture.

BACKGROUND

Light fixtures are an important kind of daily necessities in people's life. In a light fixture mounted by means of elastic strips, the elastic strips and the light fixture are usually connected to each other by screws or rivets, which results in a relatively large radial size of the light fixture and large occupation space for installation, and also results in high installation difficulty and low installation efficiency of the light fixture.

SUMMARY

The present disclosure discloses a light fixture.

The light fixture provided in present disclosure may include a light body. The light body may include a light housing and a limiting element, the limiting element may be connected to the light housing, a limiting space may be enclosed by the light housing and the limiting element, one end of the limiting space may be provided with a mounting opening, the limiting element may have a matching notch, the matching notch may be formed by extending from the mounting opening to an inside of the limiting element, and the light housing may recess to be provided with a limiting slot that communicates with the limiting space.

The light body may include elastic mounting members. Each elastic mounting member may include a clamping portion and a mounting portion, the clamping portion may include a base body and an elastic clip, the elastic clip may be elastically connected to the base body, one end of the base body may be bent outwards and extends to form the mounting portion, and the mounting portion may be configured to be fastened on a mounting base.

The clamping portion may be inserted into the limiting space from the mounting opening, the mounting portion may be inserted into the matching notch, and in a direction perpendicular to an insertion direction of the clamping portion, the base body and the light body may be in limiting fit; the elastic clip and the limiting slot may be in limiting fit, so that the clamping portion is restricted from being detached from the limiting space from the mounting opening.

It is to be understood that both the foregoing general description and the following detailed description are exemplary and explanatory only and are not restrictive of the present disclosure.

BRIEF DESCRIPTION OF THE DRAWINGS

The accompanying drawings described herein are intended for a further understanding of the present disclosure and constitute a part of the present disclosure. Examples of the present disclosure and descriptions thereof are intended to explain the present disclosure, and do not constitute any inappropriate limitation on the present disclosure. In the drawings.

DETAILED DESCRIPTION

In order to make the objectives, technical solutions, and advantages of the present disclosure clearer, the technical solutions in the examples of the present disclosure will be clearly and completely described below in combination with the examples and the corresponding drawings of the present disclosure. Apparently, the described examples are not all examples but part of examples of the present disclosure. All other examples obtained by those of ordinary skilled in the art on the basis of the examples in the present disclosure without creative work shall fall within the scope of protection of the present disclosure.

Reference and numerals in this disclosure may include:

100—light body, 110—light housing, 111—limiting slot, 112—limiting chamfer, 113—yielding chamfer, 114—edge, 120—limiting element, 121—connection portion, 122—retaining portion, 123—matching notch, 130—limiting space, 200—elastic mounting member, 210—clamping portion, 211—base, 211*a*—accommodating hole, 212—elastic clip, 220—mounting portion, 221—squeezing section, 221*a*—first bending section, 221*b*—second bending section, 222—lapping section, 223—mounting body, 224—connection terminal, 311—a free end of the elastic clip, and 300—mounting base.

Figure 1:
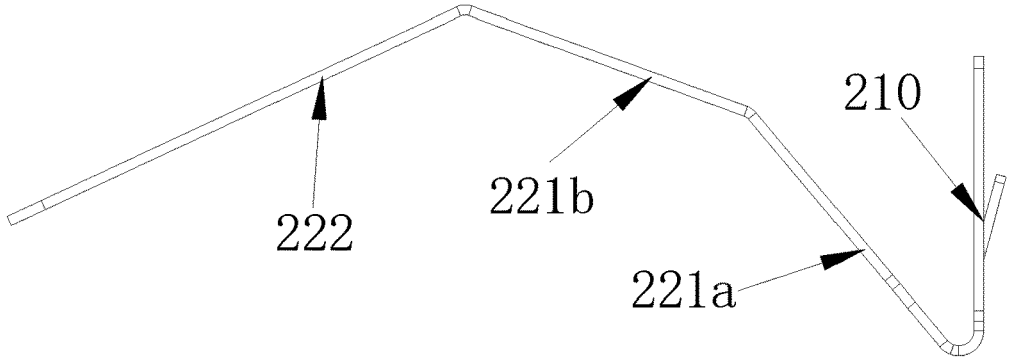
FIG. 1 is a structural schematic diagram of an elastic mounting member in a light fixture according to an example of the present disclosure.
Figure 2:
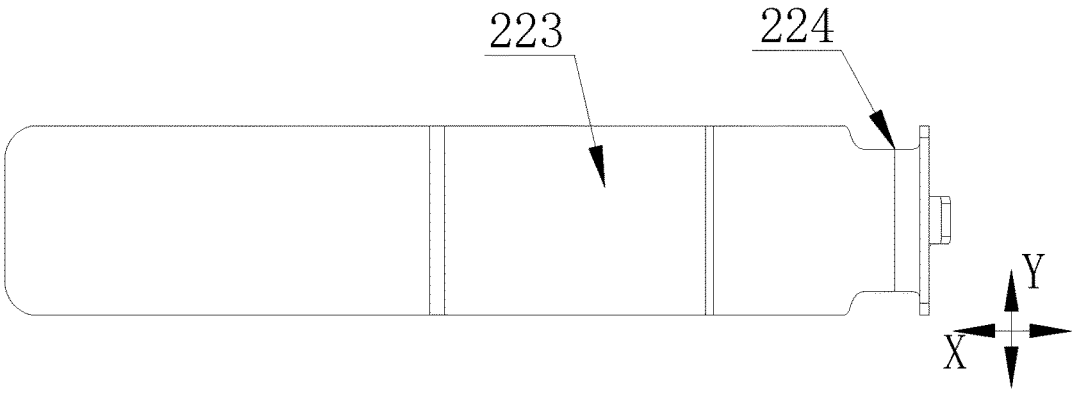
FIG. 2 is a schematic diagram of the elastic mounting member, in another direction, of the light fixture according to the example of the present disclosure.
Figure 3:
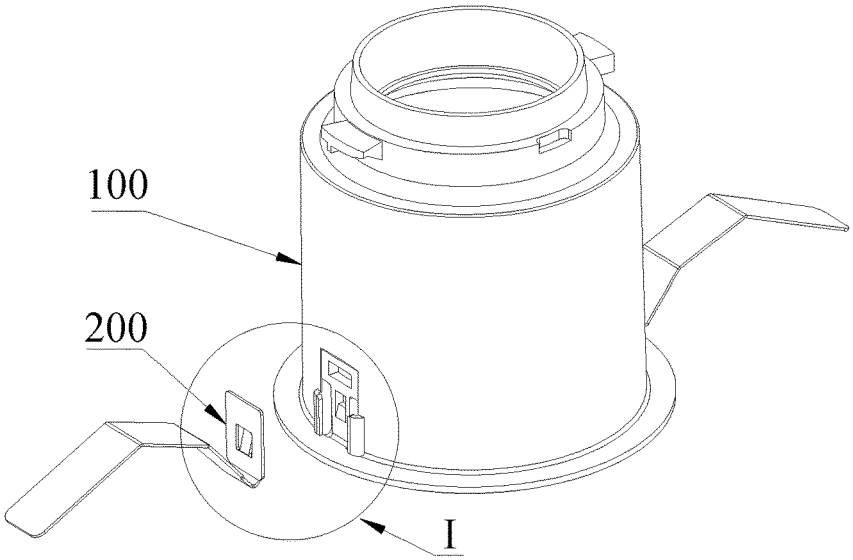
FIG. 3 is a structural schematic diagram of a light fixture according to an example of the present disclosure.
Figure 4:
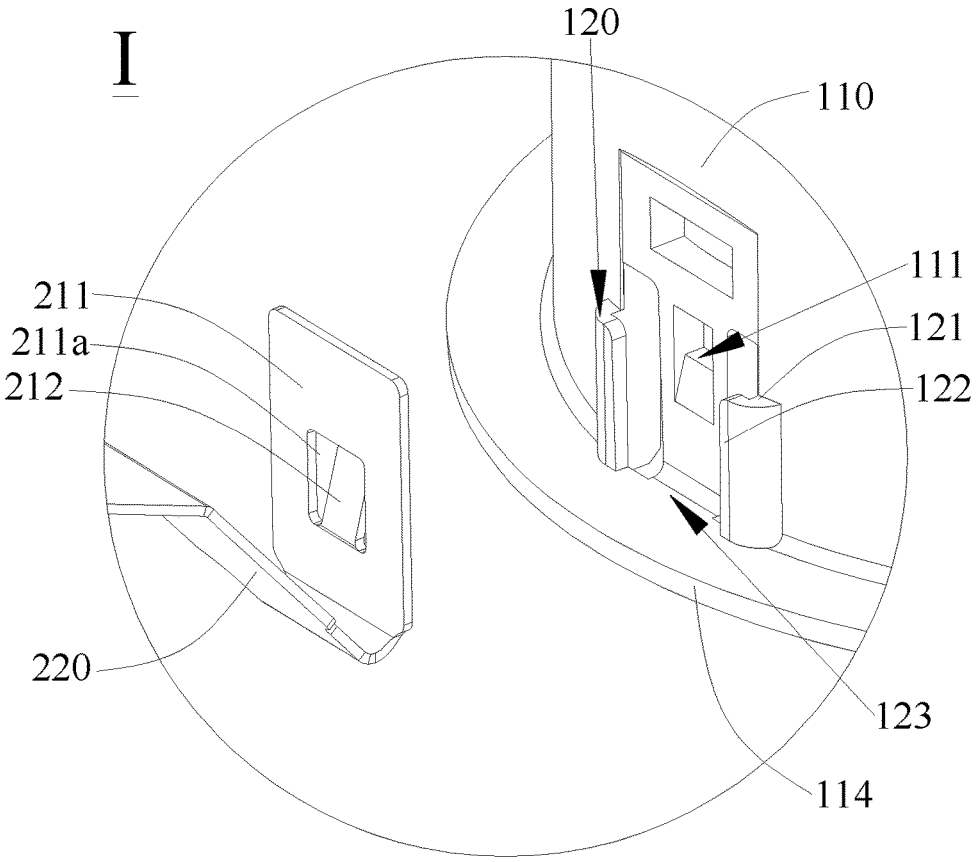
FIG. 4 is an enlarged view of part I in FIG. 3.
Figure 5:
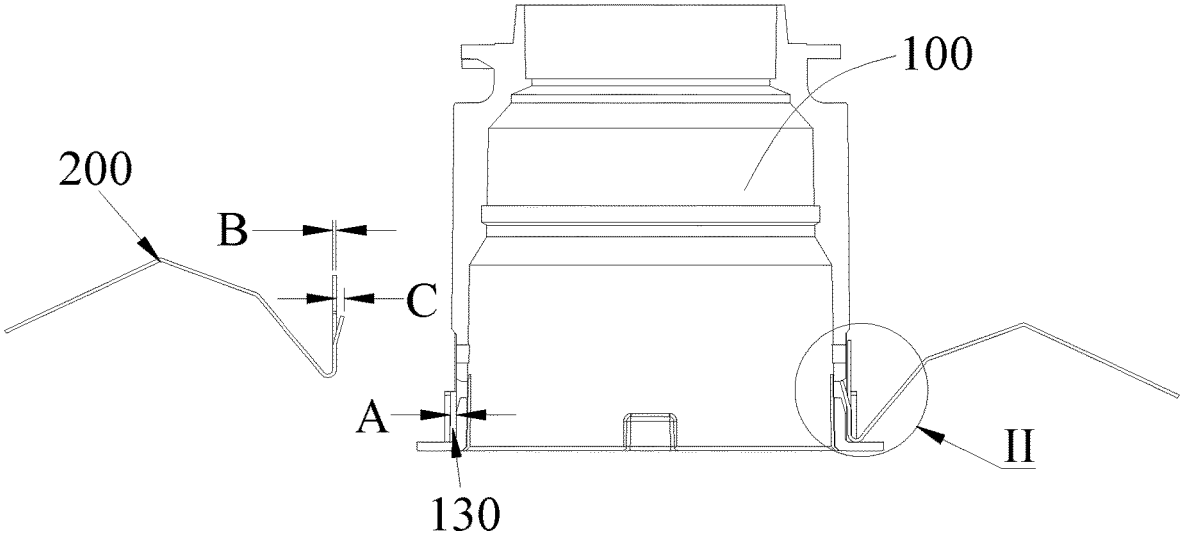
FIG. 5 is a schematic diagram of a part of structure of the light fixture according to the example of the present disclosure.
Figure 6:
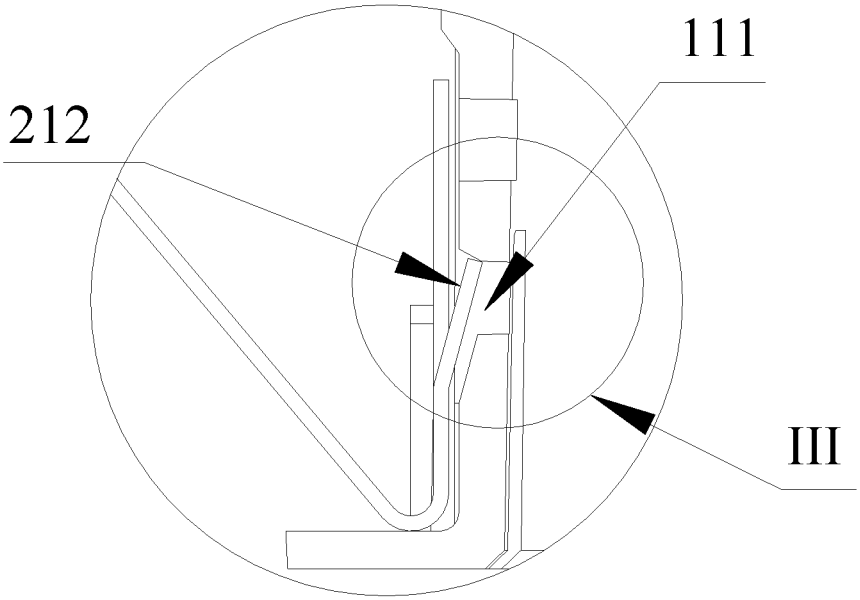
FIG. 6 is an enlarged view of part II in FIG. 5.
Figure 7:
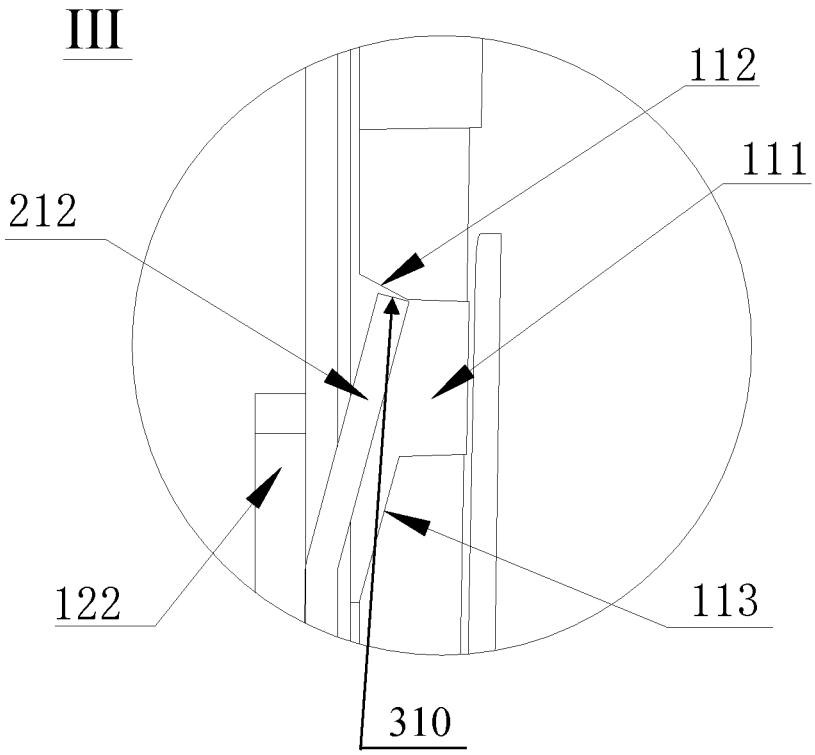
FIG. 7 is an enlarged view of part III in FIG. 6.
Figure 8:
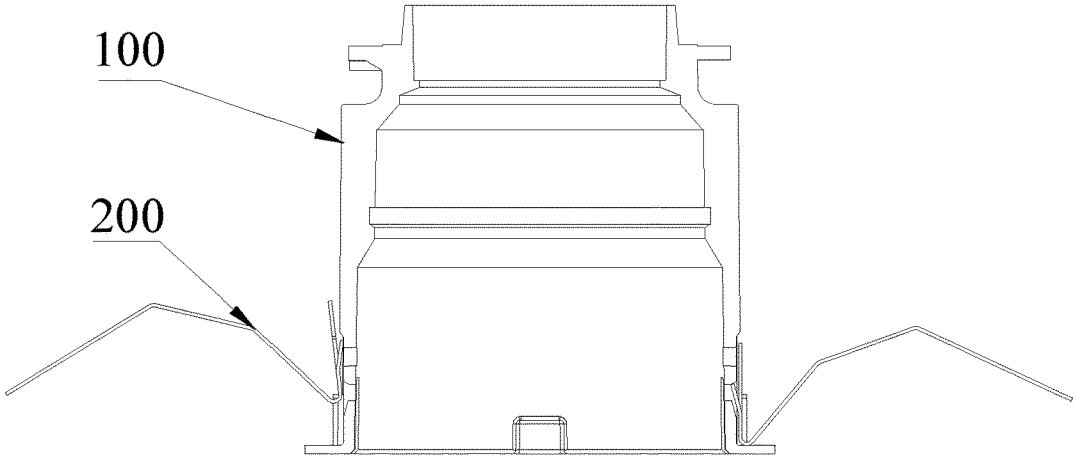
FIG. 8 is a diagram showing a matching state of a light body and an elastic mounting member of a light fixture according to an example of the present disclosure.
Figure 9:
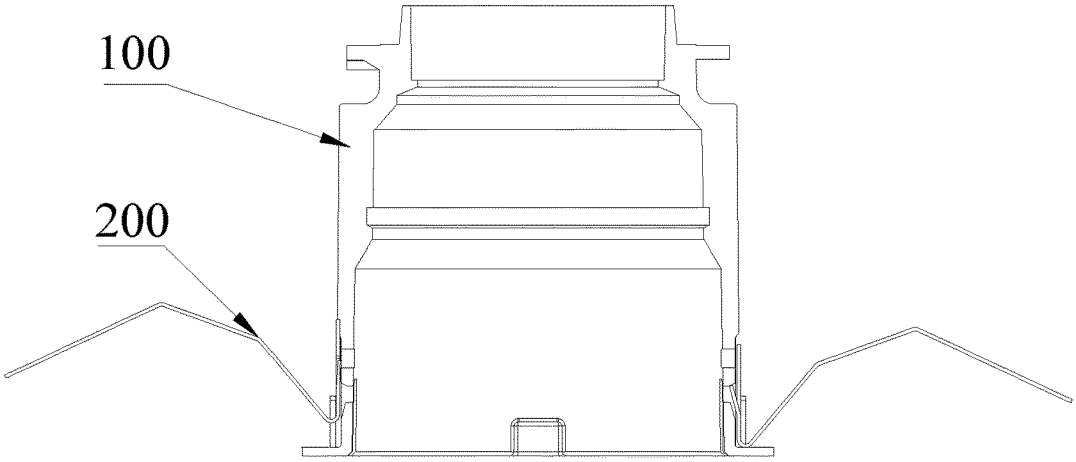
FIG. 9 is a diagram showing another matching state of the light body and the elastic mounting member of the light fixture according to the example of the present disclosure.
Figure 10:
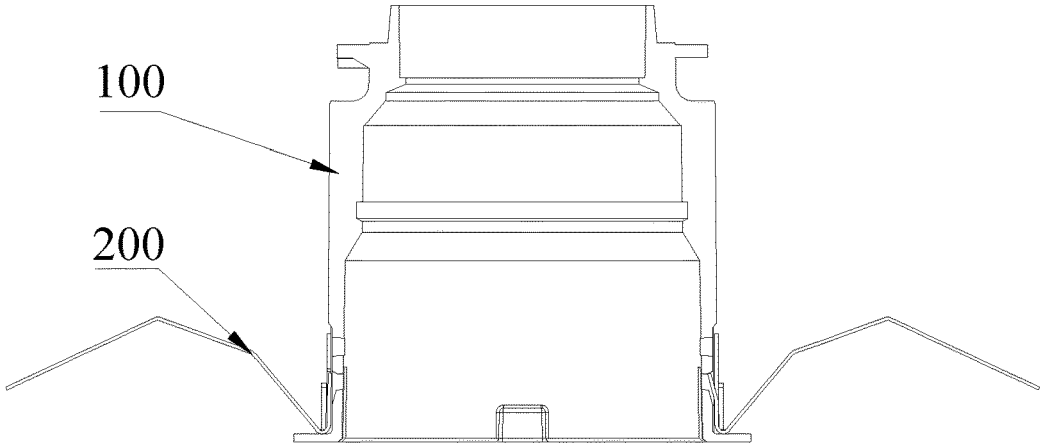
FIG. 10 is a diagram showing still another matching state of the light body and the elastic mounting member of the light fixture according to the example of the present disclosure.
Figure 11:
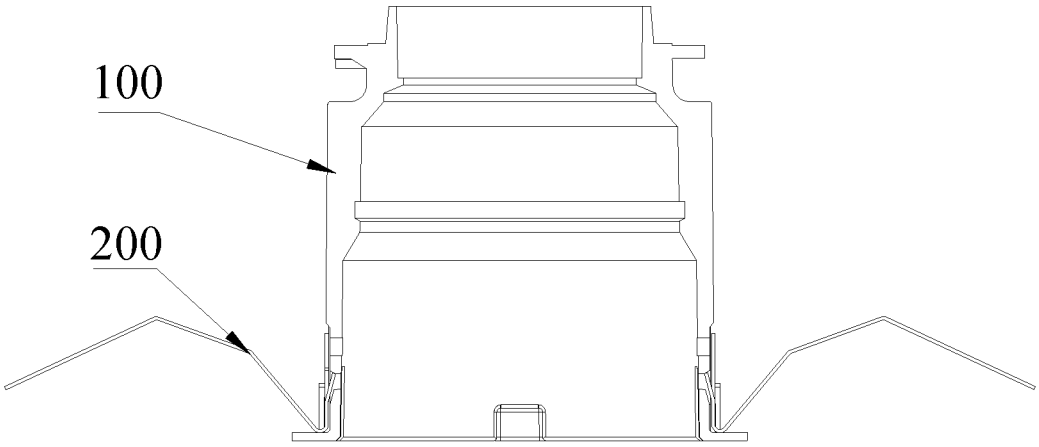
FIG. 11 is a diagram showing yet another matching state of the light body and the elastic mounting member of the light fixture according to the example of the present disclosure.
Figure 12:
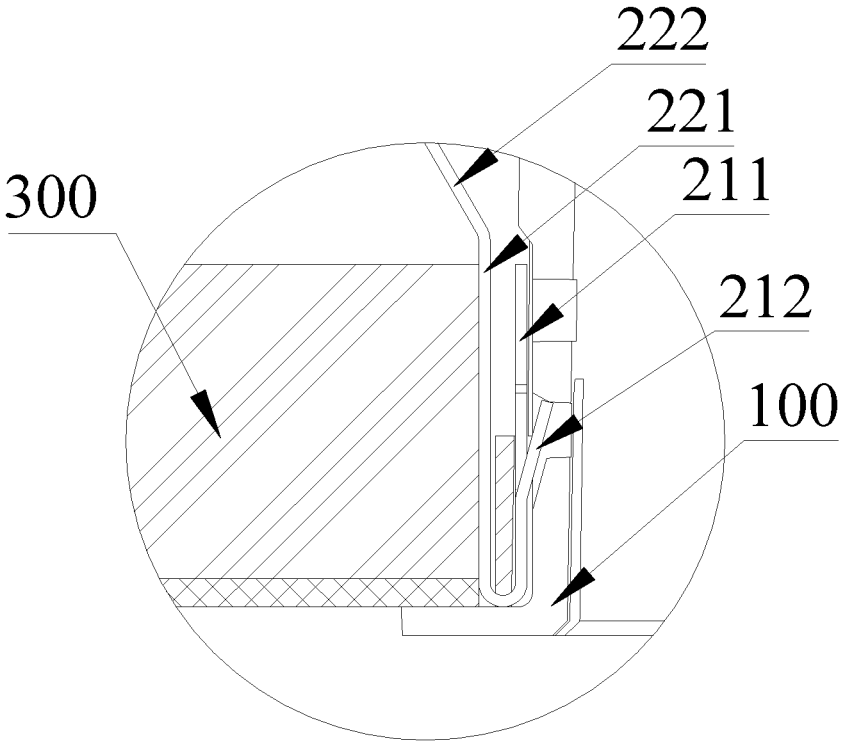
FIG. 12 is a diagram showing a matching between a part of structure of the light fixture according to the example and a mounting base.

As shown in FIG. 1 to FIG. 12, the present disclosure discloses a light fixture, including a light body 100 and elastic mounting members 200. The light body 100 is fixedly mounted on a mounting base 300 through the elastic mounting members 200.

The light body 100 includes a light housing 110 and a limiting element 120, the limiting element 120 is connected to the light housing 110, a limiting space 130 is enclosed by the limiting element 120 and the light housing 110, one end of the limiting space 130 is provided with a mounting opening, the limiting element 120 has a matching notch 123, the matching notch 123 is formed by extending from the mounting opening to the inside of the limiting element 120, and the light housing 110 recesses to be provided with a limiting slot 111 that communicates with the limiting space 130. Each elastic mounting member 200 includes a clamping portion 210 and a mounting portion 220, the clamping portion 210 includes a base body 211 and an elastic clip 212, the elastic clip 212 is elastically connected to the base body 211, and one end of the base body 211 is bent outwards and is inserted to form the mounting portion 220.

During assembling of the light housing 110 and the elastic mounting member 200, the clamping portion 210 may be inserted into the limiting space 130 from the mounting opening; correspondingly, as the clamping portion 210 is inserted into the limiting space 130, the mounting portion 220 that is formed by bending and extending of the base body 211 of the clamping portion 210 may be inserted into the matching notch 123, so that the entire elastic mounting portion 220 may have a relative displacement relative to the light body 100; when the clamping portion 210 is inserted to a designed position in the limiting space 130, the elastic clip 212 may be in limiting fit with the limiting slot 111, thereby restricting the clamping portion 210 from being detached from the limiting space 130 from the mounting opening; in a direction perpendicular to an insertion direction of the clamping portion 210, the base body 211 of the clamping portion 210 is located in the limiting space 130, so that the base body 211 may form a limiting fit relationship with the light body 100. To sum up, the clamping portion 210 of the elastic mounting member 200 is inserted into the limiting space 130 so that a reliable relatively fixed relationship is formed between the entire elastic mounting member 200 and the light body 100, and the entire light fixture can be mounted on the mounting base 300 by means of the mounting portion 220 of the elastic mounting member 200.

Specifically, the clamping portion 210 and the mounting portion 220 may be molded integrally. Optionally, the elastic mounting member 200 may be a metallic-strip structural member. With an appropriate thickness, elasticity of the elastic mounting member 200 made of metal can be ensured. Alternatively, the elastic mounting member 200 may be formed by bending a long straight metal strip. The size of the clamping portion 210 and the size of the mounting portion 220 may be determined according to actual conditions of the light body 100 and the mounting base 300, and the like. The elastic clip 212 may be connected to the base body 211 by welding or the like, or may be formed by bending relative to the base body 211. In the absence of action of an external force, an included angle between the elastic clip 212 and the base body 211 is not limited here.

The light housing 110 and the limiting element 120 may be molded in a splitting manner, and the limiting element 120 may be connected to the light housing 110 by welding, hot welding, bonding, camping fit, or embedding installation, and the like. Moreover, since structures and/or sizes of the light housing 110 and the limiting element 120 are designed, the limiting space 130 can be enclosed by the light housing 110 and the limiting element 120, and a specific size of the limiting space 130 may be correspondingly designed on the basis of the structure and size of the elastic mounting member 200. Alternatively, the light housing 110 and the limiting element 120 may be molded integrally, which may improve structural stability of the entire light body 100. The light body 100 further includes other structures, such as a light source component. The light fixture may be a down light or a spot light. In addition to the light source component, the light body may further include a light distribution element, such as a lens, a reflector and a light guide element, for distributing emergent light of the light source component. For the sake of concision, elaboration will be omitted here.

In order to allow the elastic limiting element 120 to be inserted into the limiting space 130 to form a fixed relationship with the light body 100, one end of the limiting space 130 is provided with a mounting opening. Correspondingly, in order to prevent the elastic mounting member 200 from being detached from the limiting space 130 from other positions except the mounting opening, the other positions of the limiting space 130 may be set as closed structures, or may be provided with an opening or hole with a size smaller than the size of the clamping portion 210, or may be provided with a structure that prevents the elastic mounting member 200 from being detached.

More specifically, by changing the structure of the light housing 110, for example, allowing the light housing 110 to have an edge 114 and allowing a side, leaving the mounting opening, of the limiting element 120 to be matched with the edge 114 of the light housing 110, the elastic mounting member 200 can be inserted into the limiting space 130 only from the mounting opening under the action of the matching between the edge 114 and the limiting element 120. In addition, under the retaining action of the edge 114, the elastic mounting member 200 may be prevented from continuing to be inserted, and the side, leaving the mounting opening, of the elastic mounting member 200 may be prevented from extending out of the limiting space 130. To facilitate the following description and understanding of the solutions, directions in which two ends of the limiting element 120 are located are referred to as "above" and "below". The mounting opening is located above the limiting element 120, the edge 114 is located below the limiting element 120, the clamping portion 210 is inserted into the limiting space 130 from the position above the limiting element 120, and cannot extend out of the limiting space 130 from the position below the limiting element 120 under the action of the edge 114.

As described above, one end of the base body 211 extends outwards to form the mounting portion 220, and accordingly the mounting portion 220 and the clamping portion have a non-detachable connection relationship, and in the process of inserting the clamping portion 210 into the limiting space 130 from the mounting opening, the mounting portion 220 will inevitably have a corresponding displacement. In order to ensure that the mounting portion 220 can move, along with the clamping portion 210, relative to the light body 100, the limiting element 120 is provided with the matching notch 123, and the matching notch 123 is inserted to the inside of the limiting element 120 from the mounting opening, where an insertion direction is the same as a direction in which the clamping portion 210 is inserted into the limiting space 130. In the case where the size of the matching notch 123 is matched with the size of the mounting portion 220, as the clamping portion 210 is inserted into the limiting space 130, the mounting portion 220 may also have a displacement relative to the light body 100 by being inserted into the matching notch 123.

In order to prevent the clamping portion 210 from being detached from the limiting space 130 from the matching notch 123, as described above, the size of the matching notch 123 may be smaller than the size of the clamping portion 210 in a corresponding direction, thereby ensuring that the clamping portion 210 fails to be detached from the matching notch 123. Alternatively, the shape of the matching notch 123 may be designed so that the clamping portion 210 is prevented from being detached from the limiting space 130 from the matching notch 123 by means of mutual limiting of structures. Similarly, here it is said that the limiting element 120 is located on the "left side" of the light housing 110, and the light housing 110 is located on the "right side" of the limiting element 120. Apparently, under co-action of the light housing 110 and the limiting element 120, the clamping portion 210 can be prevented from extending out of the limiting space 130 from the left side and the right side of the limiting space 130.

In addition, in order to ensure that the clamping portion 210 still cannot extend out of the limiting space 130 from the "front" and "rear" of the limiting space 130, optionally, a part of structure of the limiting element 120 may be arranged at a corresponding position of the limiting space 130. On the one hand, the position of the clamping portion 210 may be restricted by the foregoing part of structure of the limiting element 120, and on the other hand, by the foregoing part of structure of the limiting element 120, a reliable fixed connection relationship may be formed between the limiting element 120 and the light housing 110. Alternatively, in the case where the limiting element 120 is connected to the light housing 110 in other manners, other structures may be added to restrict the position of the clamping portion 210 in the limiting space 130.

Moreover, the clamping portion 210 includes an elastic clip 212, and the light housing 110 recesses to be provided with the limiting slot 111 that communicates with the limiting space 130. When the clamping portion 210 is inserted to a certain position of the limiting space 130, the elastic clip 212 may be inserted into the limiting slot 111, and be in limiting fit with the limiting slot 111 so that the clamping portion 210 is restricted from being detached from the limiting space 130 from the mounting opening. Apparently, by the elastic clip 212 and the limiting slot 111 that are in limiting fit, the clamping portion 210 can be prevented from extending out of the limiting space 130 from the position (i.e., the mounting opening) above the limiting element 120.

To sum up, the clamping portion 210 that is inserted into the limiting space 130 cannot be detached from the limiting space 130 from the position "above" or "below," or the "left side", "right side", "front", and "rear" of the limiting space 130. Moreover, even the clamping portion 210 has a displacement in an inclination direction relative to the six directions described above, it may have sub-displacements in the six directions described above. Therefore, the light fixture disclosed by the present disclosure adopts the structure, so that a stable relatively fixed relationship between the elastic mounting member 200 and the light body 100 may be ensured.

In a process of assembling the elastic mounting member 200 and the light body 100, it is only necessary to insert the elastic mounting member 200 to the limiting space 130 through the mounting opening until the elastic clip 212 and the limiting slot 111 form a fit relationship, and thus the process of assembling the elastic mounting member 200 and the light body 100 is completed, which is easy and convenient in operation, without using of tools, such as a screwdriver. Moreover, because the elastic mounting member 200 and the light body 100 are assembled without using of screws, a radial size of the light fixture may be significantly reduced, and further, occupation space for installation of the light fixture is reduced.

In addition, it is to be noted that the light fixture disclosed by the present disclosure may be a spot light. The spot light may be mounted on a roof or a ceiling. In order to mount the light fixture, a mounting hole in a shape similar to that of the light fixture may be formed on the ceiling. In an installation process of the light fixture, the light fixture is inserted in the mounting hole first; one end of the base body 211 of the clamping portion 210 is bent outwards and is inserted to form the mounting portion 220, so that the entire light fixture may be squeezed and mounted in the mounting hole under the action of the mounting portion 220 by designing sizes of the mounting hole and the light fixture. Because the mounting portion 220 has an elastic deformation relative to the base body 211, the mounting portion 220 has a deformation recovery trend under the action of its elasticity to squeeze the light fixture and a wall of the mounting hole. Under the action of a squeezing force described above, the light fixture may be stably fastened in the mounting hole. Therefore, installation of the light fixture is completed. In the case where the mounting portion 220 refers to other structures, the entire light fixture may be fastened in the mounting hole through the mounting portion 220 by other methods.

To improve stability of the fixed matching relationship between the elastic mounting member 200 and the light body 100, preferably, the base body 211 may be configured to fit an outer peripheral wall of the light housing 110. In this case, after the clamping portion 210 is inserted into the limiting space 130 and the elastic clip 212 is inserted into the limiting slot 111, the base body 211 can hardly move relative to the light body 100, which enables the limiting fit relationship between the clamping portion 210 and the light body 100 more stable.

When the light fixture adopts the structure described above, the size of the limiting space 130 may be matched with the size of the base body 211 in a corresponding direction. In order to ensure that the entire clamping portion 210 may be inserted into the limiting space 130, before the clamping portion 210 is inserted into the limiting space 130, the elastic clip 212 may have an elastic deformation in a direction approaching the base body 211, thereby reducing the overall size of the clamping portion 210 in the corresponding direction and ensuring that the clamping portion 210 can be inserted into the limiting space 130. When the clamping portion 210 is inserted to a certain position in the limiting space 130, the elastic clip 212 corresponds to the limiting slot 111, the elastic clip 212 recovers and is in limiting fit with the limiting slot 111, so that the assembling process of the light body 100 and the elastic mounting member 200 is completed.

As described above, a part of the clamping portion 210 may be bent away from the other part of the clamping portion 210 so as to form the elastic clip 212, and the other part of the clamping portion 210 is the base body 211. In this case, a forming process of the clamping portion 210 is simple relatively. Because the base body 211 and the elastic clip 212 are of an integral structure originally, structural stability of the base body 211 and the elastic clip 212 is relatively high. Moreover, elastic property of the elastic clip 212 to the base body 211 may be improved to a certain degree.

As described above, one end of the base body 211 is bent outwards and extends to form the mounting portion 220. Optionally, an end portion, leaving the mounting portion 220, of the base body 211, may be provided with the elastic clip 212 by a bending method. Correspondingly, the structure and size of the limiting slot 111 may be designed corresponding to the structure and size of the elastic clip 212, thereby ensuring that the elastic clip 212 may form a limiting fit relationship with the limiting slot 111 by being inserted into the limiting slot 111.

In addition to the mode that the elastic clip 212 is located at one end of the base body 211, the elastic clip 212 may be located in the middle of the base body 211. In detail, the base body 211 may be provided with an accommodating hole 211*a*, the accommodating hole 211 penetrates the base body 211, and a projection of the elastic clip 212 along its bouncing direction is located in the accommodating hole 211*a*.

Specifically, a part of structure of the middle of the clamping portion 210 is protruded and bent to form the elastic clip 212, and a part of structure surrounding the elastic clip 212 is the base body 211. For forming of the elastic clip 212 on the clamping portion 210, the base body 211 is required to be provided with the accommodating hole 211*a* that penetrates the base body. Apparently, the projection of the elastic clip 212 formed by the method described above, in its bouncing direction, is inevitably located in the accommodating hole 211*a*.

When the clamping portion 210 adopts the structure described above, because the elastic clip 212 may be inserted into the accommodating hole 211*a* when the elastic clip 212 elastically deforms in a direction approaching the base body 211, in a mutual matching process of the clamping portion 210 and the limiting space 130, the overall size of the clamping portion 210 is equal to the size of the base body 211 as the elastic clip 212 is located in the accommodating hole 211*a*; and thus, in a process of designing the limiting space 130, there is no need to separately reserve a matching space for the elastic clip 212, so that the size of the limiting space 130 may be designed to be smaller, and the base body 211 can hardly move relative to the light body 100 after the elastic clip 212 is in limiting fit with the limiting slot 111. This further ensures a more stable fitting relationship between the base body 211 and the outer peripheral wall of the light housing 110, and achieves a better fitting effect, thereby further improving the relatively fixed relationship between the elastic mounting member 200 and the light body 100.

In order to prevent the circumstance that the elastic clip 212 fails to be inserted into the accommodating hole 211*a* as the elastic clip 212 interferes with a side wall of the accommodating hole 211*a* when being inserted into the accommodating hole 211*a* because a size of the accommodating hole 211*a* is similar to a size of the elastic clip 212, preferably, a preset interval may be reserved between at least a side wall of the elastic clip 212 and the wall of the accommodating hole 211*a*. Thus, in a process of inserting the elastic clip 212 into the accommodating hole 211*a*, it is ensured that the elastic clip 212 can be substantially totally accommodated in the accommodating hole 211*a* when the elastic clip 212 is stressed because the size of the elastic clip 212 is smaller than the size of the accommodating hole 211*a*, thereby ensuring that the presence of the elastic clip 212 can hardly hinder insertion of the clamping portion 210 into the limiting space 130, allowing the size of the limiting space 130 to be further reduced to the size of the base body 211, and ensuring a more stable relatively fixed relationship between the base body 211 and the light body 100.

As described above, in order to prevent the clamping portion 210 extending out of the limiting space 130 from the matching notch 123, the size of the mounting portion 220 may be smaller than that of the clamping portion 210, so that the mounting portion 220 can be inserted into the matching notch 123 while the clamping portion 210 cannot extend out of the limiting space 130 from the matching notch 123.

Further, the mounting portion 220 may include a mounting body 223 and a connection terminal 224. The mounting body 223 is connected to the base body 211 through the connection terminal 224. In order to ensure that the mounting portion 220 may be inserted into the matching notch 123 with a size smaller than that of the clamping portion 210, the connection terminal 224 may be contracted relative to the mounting body 223, and the mounting body 223 is in limiting fit with the matching notch 123. That is, only the size of the connection terminal 224 of the mounting portion 220 is smaller than the size of the clamping portion 210, thereby ensuring that the entire mounting portion 220 may be inserted into the matching notch 123 along with moving of the clamping portion 210. In order to ensure that the mounting portion 220 may provide a good fastening effect to the light fixture, the size of the mounting body 223 is larger than that of the matching notch 123. The mounting body 223 of a relatively large size has a relatively large contact area with the wall of the mounting hole. In the case where the mounting portion 220 is squeezed to deform, the mounting body 223 of a relatively large size may generate a relatively large elastic acting force, thereby further ensuring the higher connection stability between the entire light fixture and the mounting base 300.

Specifically, the elastic mounting member 200 may be made of a metal strip with the set length, width, and thickness, and may be provided with the clamping portion 210 and the mounting portion 220 formed by bending. An edge of a part, connected to the clamping portion 210, of the mounting portion 220 is removed by cutting, so that a width of the part is reduced, and the connection terminal 224 is formed, while the other part may be the mounting body 223. The elastic mounting member 200 formed by the above method is easy to operate and convenient to prepare; moreover, the formed elastic mounting member 200 has higher elasticity, which can meet installation requirements of the light fixture.

As described above, the mounting portion 220 may be squeezed to produce a deformation to fasten the entire light fixture to the mounting hole. In order to enable the mounting portion 220 to provide a better mounting function to the entire light fixture, optionally, the mounting portion 220 may include a squeezing section 221 and a lapping section 222; one end of the squeezing section 221 is elastically connected to the base body 211, and the squeezing section 221 is bent relative to the base body 211; the lapping section 222 is connected to the other end of the squeezing section 221, and the lapping section 222 is bent to a side, leaving the clamping portion 210, of the squeezing section 221. In a matching process of the mounting portion 220 and the mounting hole of the mounting base 300, the squeezing section 221 may be in squeezed fit with the wall of the mounting hole, so that the entire light fixture is fastened in the mounting hole. In order to further improve a fastening effect between the light fixture and the mounting base 300, at least part of the lapping section 222 is allowed to extend out of the mounting hole.

When the mounting portion 220 adopts the structure described above, the mounting portion 220 is of a three-section structure. In a process of combining the mounting portion 220 with the mounting hole, the squeezing section 221 will be squeezed to bend in a direction approaching the clamping portion 210 as the light fixture is integrally mounted in the mounting hole, which makes the squeezing section 221 having a deformation recovery trend to move in a direction leaving the clamping portion 210, so that the squeezing section 221 can be in squeezed fit with the wall of the mounting hole, a radial acting force is formed between the light fixture and the mounting hole, and a fixed relationship formed between the light fixture and the mounting base 300 is ensured.

Moreover, because of the dead weight of the light fixture, when the light fixture is mounted on the mounting base 300, such as the ceiling, in order to ensure that a light ray generated by the light fixture can pass through the ceiling and irradiate the position below the ceiling, the mounting hole is usually a through hole, and the light fixture will have a downward moving trend under the action of the dead weight. Once the squeezing section 221 fails to provide a strong installation fastening effect, the light fixture may be detached from the mounting hole to fall off. In the light fixture disclosed by the present disclosure, the mounting portion 220 also includes the lapping section 222 besides the squeezing section 221. In the installation process of the light fixture, at least part of the lapping section 222 is located outside the mounting hole. Moreover, the lapping section 222 is bent to a side leaving the base body 211, so that the lapping section 222 may extend to the outer side of the mounting hole, and the lapping section may achieve an effect of lapping on a surface of the mounting base 300 for the entire light fixture. Under the action of the lapping section 222, the trend of the light fixture moving to the position below the ceiling may be further eliminated, thereby preventing the light fixture from being detached from the mounting base 300.

Considering that the mounting base 300, such as the ceiling, has various thicknesses, in order to widen adaptability of the light fixture disclosed by the present disclosure and allow the light fixture to be reliably mounted on the mounting base 300 with various thicknesses, optionally, the squeezing section 221 may include a first bending section 221*a* and a second bending section 221*b*, the first bending section 221*a* is connected to the base body 211 and the second bending section 221*b*, the first bending section 221*a* is bent relative to the base body 211, the second bending section 221*b* is bent to a side leaving the first bending section 221*a*, the lapping section 222 is connected to the second bending section 221*b*, and the lapping section 222 is bent to a side leaving the base body 211.

When the mounting portion 220 adopts the structure described above, the mounting portion 220 may form a reliable limiting fit relationship with the mounting base 300 of various sizes.

Specifically, a maximum length of the squeezing section 221, namely the sum of a length of the first bending section 221*a* and a length of the second bending section 221*b* is matched with a size of the mounting base 300 with a maximum thickness that is widely used in the market, so that in a process of mutual matching with the mounting base 300 with a larger thickness, the first bending section 221*a* and at least part of the second bending section 221*b* may be accommodated in the mounting hole, and squeezed with the light body 100 and the wall of the mounting hole, thereby providing a fastening effect to the light body 100. Moreover, at least part of the lapping section 222 is located outside the mounting hole, thereby providing a lapping effect for the light body 100 and the entire light body 100, and ensuring high connection reliability between the light fixture and the mounting base 300.

When the light fixture of the above structure is matched with the mounting base 300 of a relatively small size, at least part of the first squeezing section 221 can be located in the mounting hole, and squeezed with the light body 100 and the wall of the mounting hole to provide a fastening effect to the light body 100. When the entire second bending section 221*b* is located outside the mounting hole, because the second bending section 221*b* is bent to a side leaving the first bending section 221*a*, the second bending section 221*b* may achieve an effect similar to that of the lapping section 222, providing a lapping effect for the light body 100 and the entire light body 100 and ensuring high connection reliability between the light fixture and the mounting base 300. When the first bending section 221*a* and at least part of the second bending section 221*b* are located in the mounting hole, because the lapping section 222 is still located outside the mounting hole, the high connection reliability between the light fixture and the mounting base 300 can still be ensured.

Apparently, when the mounting portion 220 of the light fixture disclosed by the present disclosure adopts the structure described above, an application range of the entire light fixture may be expanded.

Further, the limiting element 120 may include two rails. The two rails are spaced apart from each other to form the matching notch 123. In the process of inserting the clamping portion 210 into the limiting space 130, the limiting element 120 formed by the two rails may have a limiting and guiding function on the clamping portion 210, thereby further reducing difficulty in assembling between the elastic mounting member 200 and the light body 100. Moreover, under the action of the two rails, the limiting element 120 may have limiting effects on the "front" and "rear" of the clamping portion 210, and may also have limiting effects on the "left side", "right side", and the position "below" when being matched with the light body 100.

Specifically, the structures and sizes of the two rails may be the same correspondingly. The two rails may be fastened on the light body 100 by bonding, welding, and the like. A set interval is reserved between the two rails so that the matching notch 123 is formed.

Further, each rail may include a connection portion 121 and a retaining portion 122, and the retaining portion 122 is connected to the light housing 110 through the connection portion 121. The base body 211 is limited and mounted between the two connection portions 121 along a first direction. The base body 211 is limited and mounted between the retaining portions 122 and the light housing 110 along a second direction. The first direction and the second direction are perpendicular to each other, and both are perpendicular to the insertion direction of the clamping portion 210.

Specifically, the connection portion 121 and the retaining portion 122 may be molded integrally, which may improve processing efficiency of the light fixture. When each rail includes the connection portion 121 the retaining portion 122, it can be ensured that the base body 211 and the light body 100 can be in limiting fit in a direction perpendicular to the insertion direction of the clamping portion 210. The first direction may be a direction in which the "front" and "rear" described above are located, and the second direction may be direction in which the "left side" and "right side" described above are located. In addition, the first direction may be a direction Y in FIG. 2, the second direction may be a direction X in FIG. 2, and the "above" and "below" described above may be a direction perpendicular to a principle plane in FIG. 2.

Further, a size of the limiting space 130 in the second direction may be A, a size of the base body 211 in the second direction may be B, and an interval between the elastic clip 212 and the base body 211 in the second direction may be C. The base body 211 is required to be inserted into the limiting space 130, and in order to ensure that the elastic clip 212 can be squeezed to deform when being inserted into the limiting space 130, it is apparent that both B and C need to be greater than A. In order to achieve a relatively low difficulty in inserting the clamping portion 210 into the limiting space 130 when the matching relationship between the base body 211 and the limiting space 130 is relatively reliable, a difference value between A and B may be greater than 0.2 mm. Moreover, in order to enable the matching relationship between the elastic clip 212 and the limiting slot 111 to be more stable, a difference value between C and A may be greater than 0.5 mm. It is to be noted that the interval C between the elastic clip 212 and the base body 211 is an interval between the elastic clip 212 that is in a natural state and the base body 211.

As described above, the limiting slot 111 is recessed on the light housing 110, and the limiting slot 111 communicates with the limiting space 130. When the clamping portion 210 is inserted to a certain position in the limiting space 130, the elastic clip 212 may be inserted into the limiting slot 111, and forms the limiting fit relationship with the limiting slot 111. Because the elastic clip 212 may prevent the clamping portion 210 from being detached from the limiting space 130 from the mounting opening, there is inevitably an interaction force, opposite to the insertion direction of the clamping portion 210, between the elastic clip 212 and the limiting slot 111. Under the action of the interaction force, the elastic clip 212 may prevent the clamping portion 210 from being detached from the limiting space 130 from the mounting opening. However, in order to ensure that the entire light fixture can be fastened to the mounting hole by the mounting portion 220 that is in squeezed fit with the mounting hole, the clamping portion 210 is usually required to be inserted into the limiting space 130 along a direction of gravity, so that the interaction force between the elastic clip 212 and the limiting slot 111 at least has a component force along the direction of gravity. After the light fixture is mounted in the mounting space, the gravity of the light fixture may act on the mounting base 300 through the elastic mounting member 200. The elastic clip 212 and the mounting portion 220 of the elastic mounting member 200 are respectively in direct contact with the light fixture and the mounting base 300, so that the gravity of the light fixture will indirectly act on the mounting base 300 through the elastic clip 212 and the mounting portion 220. Moreover, the elastic clip 212 has elasticity, and the elastic clip 212 may deform under the action of gravity of the light fixture to move relative to the base body 211, which will obviously have an adverse effect on the relatively fixed relationship between the light fixture and the mounting base 300.

For solving the above technical problems, a limiting chamfer 112 may be formed at a wall, matched with a free end of the elastic clip 212, of the limiting wall 111, and in the process of assembling the elastic mounting member 200 and the light body 100, the free end of the elastic clip 212 is in limiting fit with the limiting chamfer 112.

In this case, with the fit between the elastic clip 212 and the limiting chamfer 112, the elastic clip 212 can hardly move relative to the limiting slot 111 in the absence of action of other external forces (excluding the gravity of the light fixture) after the elastic clip 212 is inserted into the limiting slot 111.

In detail, after being inserted into the limiting slot 111, the elastic clip 212 can only move in a direction leaving the base body 211, except for moving in a direction approaching the base body 211; and because the wall of the limiting slot 111 is provided with the limiting chamfer 112, once the elastic clip 212 and the limiting chamfer 112 form a limiting fit relationship, the elastic clip 212 cannot continue to move in the direction leaving the base body 211.

Moreover, after the elastic clip 212 is inserted into the limiting slot 111, at least part of its deformation is recovered, so that if the elastic clip 212 moves in the direction approaching the base body 211, it requires to rely on an external force. When the mounting opening is arranged above the limiting element 120, the action of gravity of the light fixture will cause the elastic mounting member 200 to have a downward movement trend, which will cause the elastic clip 212 to move further in the direction leaving the base body 211. However, if the mounting opening is arranged below the limiting element 120, under the action of gravity of the light fixture, the elastic mounting member 200 will still have a downward movement trend, which will not cause the elastic clip 212 to move in the direction approaching the base body 211.

Further, by designing the structures and sizes of the limiting slot 111, the elastic clip 212, and the limiting chamfer 112, the elastic clip 212 can form a limiting fit relationship with the limiting chamfer 112 only when part of the deformation is restored. In this case, the elastic clip 212 cannot completely recover from the deformation, and under the elastic acting force of the elastic clip 212, the elastic clip 212 has a trend to continue to recover from the deformation, in a direction leaving the base body 211. This can further prevent the elastic clip 212 from being detached from the limiting slot 111 due to shake and the like, thereby ensuring the high connection reliability between the light fixture and the mounting base 300.

In order to ensure that the elastic clip 212 has higher elasticity, the elastic clip 212 may be of a straight plate structure. In this case, as the free end of the elastic clip 212 is inserted into the limiting slot 111, the part where the elastic clip 212 and the base body 211 are connected will also move in a direction leaving the base body 211. In order to prevent the light housing 110 from restricting the part where the elastic clip 212 and the base body 211 are connected from moving in the direction leaving the base body 211, the size of the limiting space 130 may be larger than the size of the base body 211 in a corresponding direction. However, this will inevitably reduce a matching effect between the base body 211 and the limiting space 130. Therefore, preferably, a yielding chamfer 113 may be formed at a wall of the limiting slot 111 approaching the part where the elastic clip 212 and the base body 211 are connected, so that in the process of inserting the free end of the elastic clip 212 into the limiting slot 111, the yielding chamfer 113 have an avoiding function to the part where the elastic clip 212 and the base body 211 are connected. In this case, the size of the limiting space 130 is only required to be slightly larger than the size of the base body 211, thereby ensuring a better relative fastening effect between the base body 211 and the light body 100.

The present disclosure discloses a light fixture, for solving the problems that the conventional light fixture has a relatively large radial size after being mounted by screws, and has high installation difficulty, and low installation efficiency.

The present disclosure discloses a light fixture, for solving the problems that certain light fixture has a relatively large radial size after being mounted by screws, and has high installation difficulty, and low installation efficiency.

The present disclosure adopts the following technical solutions.

a light fixture, which comprises:

a light body (100), wherein the light body (100) comprises a light housing (110) and a limiting element (120), the limiting element (120) is connected to the light housing (110), a limiting space (130) is enclosed by the light housing (110) and the limiting element (120), one end of the limiting space (130) is provided with a mounting opening, the limiting element (120) has a matching notch (123), the matching notch (123) is formed by extending from the mounting opening to an inside of the limiting element (120), and the light housing (110) recesses to be provided with a limiting slot (111) that communicates with the limiting space (130); and elastic mounting members (200), wherein each elastic mounting member (200) comprises a clamping portion (210) and a mounting portion (220), the clamping portion (210) comprises a base body (211) and an elastic clip (212), the elastic clip (212) is elastically connected to the base body (211), one end of the base body (211) is bent outwards and extends to form the mounting portion (220), and the mounting portion (220) is configured to be fastened on a mounting base, wherein the clamping portion (210) is inserted into the limiting space (130) from the mounting opening, the mounting portion (220) is inserted into the matching notch (123), and in a direction perpendicular to an insertion direction of the clamping portion (210), the base body (211) and the light body (100) are in limiting fit; the elastic clip (212) and the limiting slot (111) are in limiting fit, so that the clamping portion (210) is restricted from being detached from the limiting space (130) from the mounting opening.

The technical solutions adopted by the present disclosure can achieve the following beneficial effects.

In the light fixture disclosed by the present disclosure, the light housing and the limiting element enclose to form the limiting space, the clamping portion of the elastic mounting member may be inserted into the limiting space from the mounting opening of the limiting space, and the limiting element is provided with the matching notch that extends from the mounting opening to the inside of the limiting element. In a process of inserting the clamping portion into the limiting space, the mounting portion, connected to the clamping portion, of the elastic mounting member may be inserted into the matching notch; after the clamping portion is inserted into the limiting space, the base body of the clamping portion and the light body form a limiting fit relationship in a direction perpendicular to an insertion direction of the clamping portion; an elastic clip of the clamping portion is inserted to a limiting slot that is recessed on the light housing, so that the clamping portion may be prevented from being detached from the limiting space from the mounting opening, thereby ensuring a reliable relatively fixed relationship between the elastic mounting member and the light body; in addition, the mounting portion located outside the light body may be matched with a mounting base such as a ceiling, achieving the purpose of fixed connection of the light body and the mounting base, and implementing installation of the light fixture. It is apparent that the light fixture disclosed by the present disclosure does not need connectors such as screws or rivets during installation, and only needs to allow the limiting space on the light body to accommodate the clamping portion, which may enable the radial size of the entire light fixture to be smaller and further enable an installation space occupied by the light fixture to be smaller relatively. Moreover, for the light body and the elastic mounting member that are in inserted fit, the connection process is simple, the operation difficulty is low, and the installation efficiency of the light fixture may be improved.

The above examples of the present disclosure focus on the differences between the various examples. As long as different optimization features between the various examples are not contradictory, they can be combined to form additional examples. For the sake of concision, elaboration will be omitted here.

The above is only the examples of the present disclosure and is not intended to limit the present disclosure. For those skilled in the art, the present disclosure can have various modifications and variations. Any modifications, equivalent replacements, improvements and the like within the spirit and principle of the present disclosure shall fall within the scope of the present disclosure.

What is claimed is:

1. A light fixture, comprising:

a light body, wherein the light body comprises a light housing and a limiting element, the limiting element is connected to the light housing, a limiting space is enclosed by the light housing and the limiting element, one end of the limiting space is provided with a mounting opening, the limiting element has a matching notch, the matching notch is formed by extending from the mounting opening to an inside of the limiting element, and the light housing recesses to be provided with a limiting slot that communicates with the limiting space; and elastic mounting members, wherein each elastic mounting member comprises a clamping portion and a mounting portion, the clamping portion comprises a base body and an elastic clip, the elastic clip is elastically connected to the base body, one end of the base body is bent outwards and extends to form the mounting portion, and the mounting portion is configured to be fastened on a mounting base, and wherein the clamping portion is inserted into the limiting space from the mounting opening, the mounting portion is inserted into the matching notch, and in a direction perpendicular to an insertion direction of the clamping portion, the base body and the light body are in limiting fit; the elastic clip and the limiting slot are in limiting fit, so that the clamping portion is restricted from being detached from the limiting space from the mounting opening, and wherein the base body is further connected to a squeezing section that is bent relative to the base body, and when the mounting portion is inserted into the matching notch in the direction perpendicular to the insertion direction of the clamping portion to form the limiting fit between the base body and the light body, the squeezing section is in squeezed fit with the mounting base.

2. The light fixture according to claim 1, wherein the base body is configured to fit an outer peripheral wall of the light housing.

3. The light fixture according to claim 1, wherein a part of the clamping portion leaves the other part of the clamping portion to be bent to form the elastic clip, and the other part of the clamping portion is the base body.

4. The light fixture according to claim 3, wherein the base body has an accommodating hole, the accommodating hole penetrates the base body, and a projection of the elastic clip along a bouncing direction of the elastic clip is located in the accommodating hole.

5. The light fixture according to claim 4, wherein a preset interval is reserved between at least one side wall of the elastic clip and a wall of the accommodating hole.

6. The light fixture according to claim 1, wherein the mounting portion comprises a mounting body and a connection terminal, the mounting body is connected to the base body through the connection terminal, the connection terminal is contracted relative to the mounting body, the connection terminal is inserted into the matching notch, and the mounting body is in limiting fit with the matching notch.

7. The light fixture according to claim 1, wherein the mounting portion comprises a squeezing section and a lapping section, one end of the squeezing section is elastically connected to the base body, the squeezing section is bent relative to the base body, and the squeezing section is configured to be squeezed onto a wall of a mounting hole of the mounting base; the lapping section is connected to the other end of the squeezing section, the lapping section is bent to a side of the squeezing section, the lapping section is bent to a side leaving the base body, and at least part of the lapping section is configured to extend out of the mounting hole.

8. The light fixture according to claim 7, wherein the squeezing section comprises a first bending section and a second bending section, the first bending section is connected to the base body and the second bending section, the first bending section is bent relative to the base body, the second bending section is bent to a side leaving the first bending section, the lapping section is connected to the second bending section, and the lapping section is bent to a side leaving the base body.

9. The light fixture according to claim 1, wherein the limiting element comprises two rails, and the two rails are spaced apart from each other to form the matching notch.

10. The light fixture according to claim 9, wherein each rail comprises a connection portion and a retaining portion, the retaining portion is connected to the light housing through the connection portion, the base body is limited and mounted between two connection portions along a first direction, the base body is limited and mounted between the retaining portion and the light housing along a second direction, the first direction and the second direction are perpendicular to each other, and both are perpendicular to the insertion direction of the clamping portion.

11. The light fixture according to claim 10, wherein a size of the limiting space in the second direction is A, a size of the base body in the second direction is B, an interval between the elastic clip and the base body in the second direction is C, a difference value between A and B is greater than 0.2 mm, and/or a difference value between C and A is greater than 0.5 mm.

12. The light fixture according to claim 1, wherein the limiting slot is provided with a limiting chamfer, the limiting chamfer is matched with a free end of the elastic clip, and the free end is in limiting fit with the limiting chamfer.

13. The light fixture according to claim 1, wherein a wall, approaching a part where the elastic clip and the base body are connected, of the light housing, is provided with a yielding chamfer, and the yielding chamfer is used to avoid the elastic clip that is in limiting fit with the limiting slot.

* * * * *